US005489144A

United States Patent [19]

Lewis

[11] Patent Number: 5,489,144

[45] Date of Patent: Feb. 6, 1996

[54] PORTABLE FOLDING FOOTSTOOL

[76] Inventor: Claude Lewis, 413 Hamblin Rd., Evarts, Ky. 40828

[21] Appl. No.: 333,721

[22] Filed: Nov. 3, 1994

[51] Int. Cl.[6] ..... A47C 10/02

[52] U.S. Cl. ..... 297/423.41; 108/131; 297/17

[58] Field of Search ..... 297/17, 54, 423.41; 108/117, 129–132

[56] References Cited

U.S. PATENT DOCUMENTS

| | | | |
|---|---|---|---|
| 272,909 | 2/1883 | Shattuck | 108/131 |
| 493,021 | 3/1893 | Franks | 108/132 |
| 2,385,458 | 9/1945 | Naon | 108/131 |
| 2,615,500 | 10/1952 | Themas | 297/54 |
| 5,259,305 | 11/1993 | Korb | 108/132 |

FOREIGN PATENT DOCUMENTS

| | | | |
|---|---|---|---|
| 70896 | of 1916 | Australia | 108/129 |
| 2829691 | 4/1980 | Germany | 297/423.41 |

*Primary Examiner*—Peter R. Brown

[57] ABSTRACT

A footstool for supporting the legs of an individual relative to a ground surface. The inventive device includes a support member for receiving the individual's legs. A folding leg assembly positions the support member above the ground surface and can be folded flatly against the support member for storage and/or transportation purposes.

2 Claims, 4 Drawing Sheets

PORTABLE FOLDING FOOTSTOOL

BACKGROUND OF THE INVENTION

1. Field of the Invention

The present invention relates to support structures and more particularly pertains to a portable folding footstool for supporting the legs of an individual relative to a ground surface.

2. Description of the Prior Art

The use of support structures is known in the prior art. More specifically, support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art support structures include U.S. Pat. Nos. 5,004,690; 4,328,992; 4,290,502; 3,833,089; and 3,770,316.

While these devices fulfill their respective, particular objectives and requirements, the aforementioned patents do not disclose a portable folding footstool for supporting the legs of an individual relative to a ground surface which includes a support member receiving the individual's legs thereon, and a folding leg assembly for positioning the support member above the ground surface which can be folded flatly against the support member for storage and transportation purposes.

In these respects, the portable folding footstool according to the present invention substantially departs from the conventional concepts and designs of the prior art, and in so doing provides an apparatus primarily developed for the purpose of supporting the legs of an individual relative to a ground surface.

SUMMARY OF THE INVENTION

In view of the foregoing disadvantages inherent in the known types of support structures now present in the prior art, the present invention provides a new portable folding footstool construction wherein the same can be utilized for supporting the legs of an individual. As such, the general purpose of the present invention, which will be described subsequently in greater detail, is to provide a new portable folding footstool apparatus and method which has many of the advantages of the support structures mentioned heretofore and many novel features that result in a portable folding footstool which is not anticipated, rendered obvious, suggested, or even implied by any of the prior art support structures, either alone or in any combination thereof.

To attain this, the present invention generally comprises a footstool for supporting the legs of an individual relative to a ground surface. The inventive device includes a support member for receiving the individual's legs. A folding leg assembly positions the support member above the ground surface and can be folded flatly against the support member for storage and/or transportation purposes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable folding footstool apparatus and method which has many of the advantages of the support structures mentioned heretofore and many novel features that result in a portable folding footstool which is not anticipated, rendered obvious, suggested, or even implied by any of the prior art support structures, either alone or in any combination thereof.

It is another object of the present invention to provide a new portable folding footstool which may be easily and efficiently manufactured and marketed.

It is a further object of the present invention to provide a new portable folding footstool which is of a durable and reliable construction.

An even further object of the present invention is to provide a new portable folding footstool which is susceptible of a low cost of manufacture with regard to both materials and labor, and which accordingly is then susceptible of low prices of sale to the consuming public, thereby making such portable folding footstools economically available to the buying public.

Still yet another object of the present invention is to provide a new portable folding footstool which provides in the apparatuses and methods of the prior art some of the advantages thereof, while simultaneously overcoming some of the disadvantages normally associated therewith.

Still another object of the present invention is to provide a new portable folding footstool for supporting the legs of an individual relative to a ground surface.

Yet another object of the present invention is to provide a new portable folding footstool which includes a support member receiving the individual's legs thereon, and a folding leg assembly for positioning the support member above the ground surface which can be folded flatly against the support member for storage and transportation purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
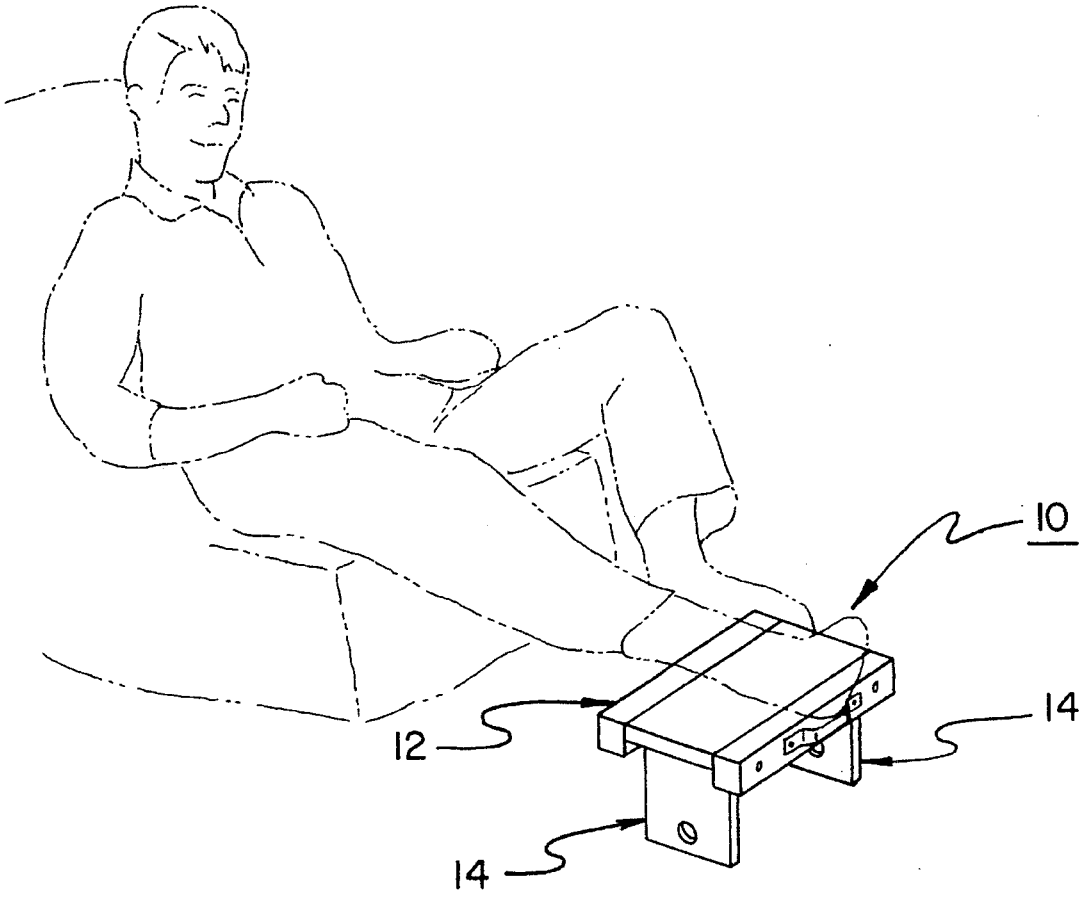
FIG. 1 is an isometric illustration of a portable folding footstool according to the present invention in use.

With reference now to the drawings, and in particular to FIGS. 1–8 thereof, a new portable folding footstool embodying the principles and concepts of the present invention and generally designated by the reference numeral 10 will be described.

Figure 2:
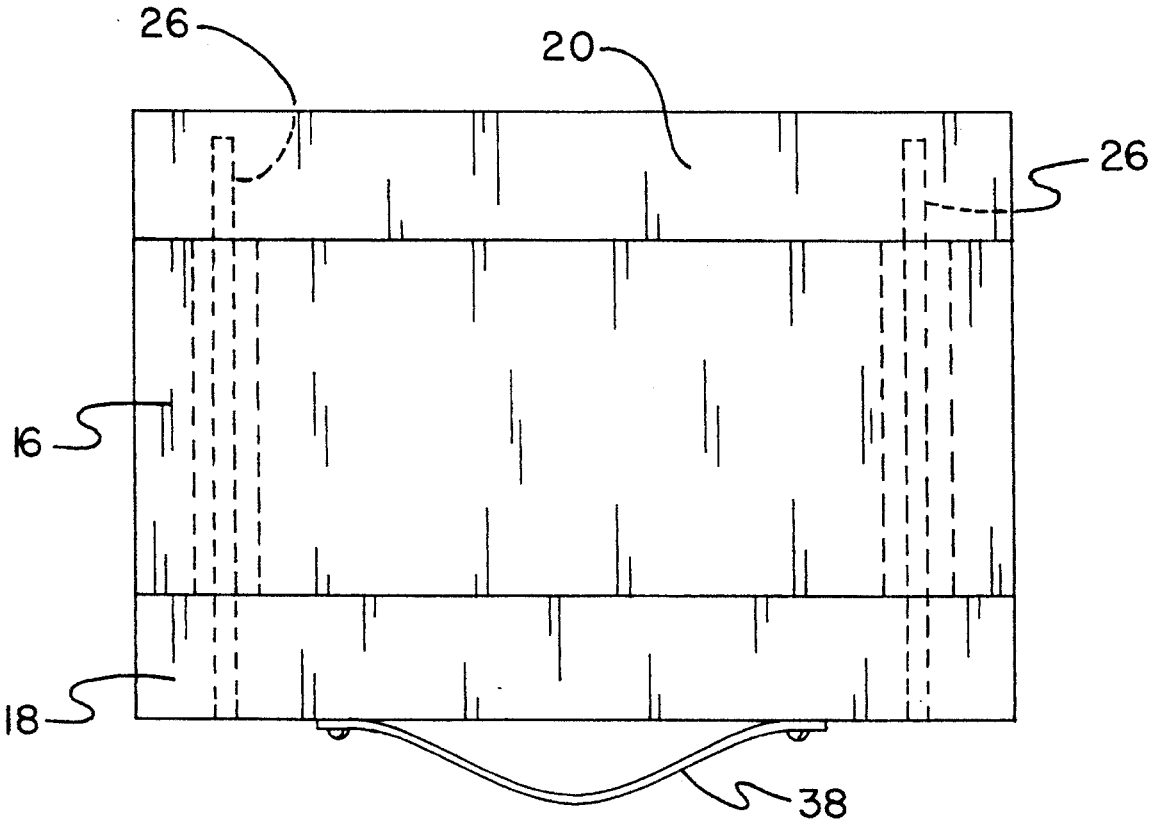
FIG. 2 is a top plan view of the footstool, per se.

More specifically, it will be noted that the portable folding footstool 10 comprises a planar support means 12 for engaging an individual's legs, and a folding leg means coupled to the support means 12 for supporting the support means and the associated individual's legs above a ground surface, as best illustrated in FIG. 1. The support means 12, as shown in FIG. 2, of the present invention preferably comprises a substantially rectangular planar member 16 having a first longitudinal member 18 extending along a first longitudinal side of the planar member, and a second longitudinal member 20 extending along a second longitudinal side of the planar member. By this structure, the upper surface of the planar member 16 cooperates with the upper surfaces of the longitudinal members 18, 20 to define a substantially flat area upon which an individual may rest his lower legs or feet, as shown in FIG. 1.

Figure 3:
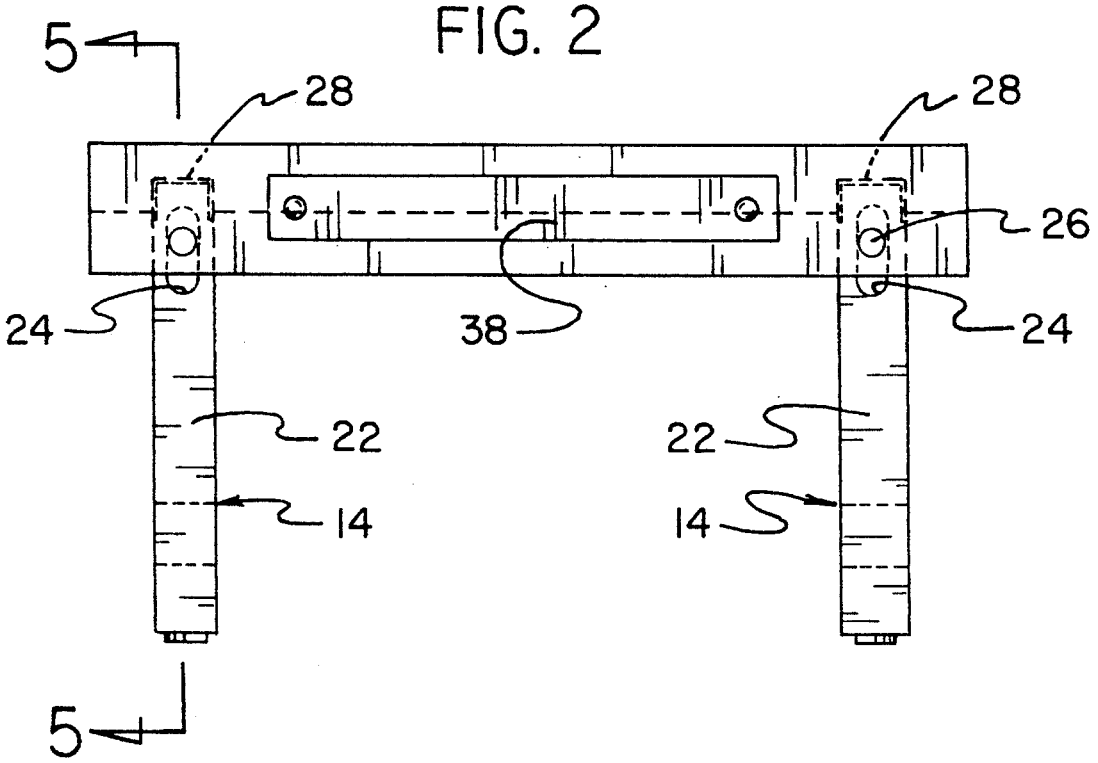
FIG. 3 is a front elevation view of the invention.
Figure 4:
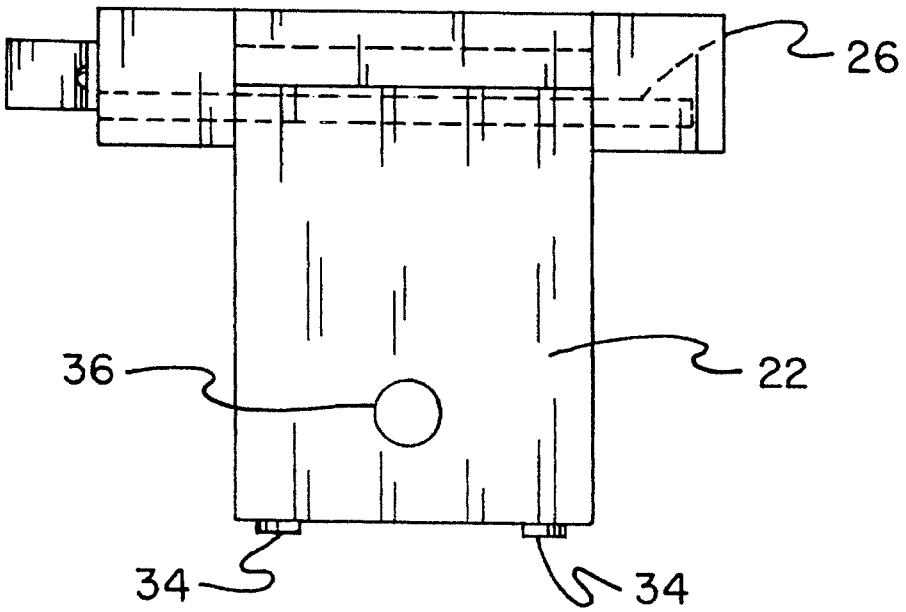
FIG. 4 is a side elevation view thereof.
Figure 5:
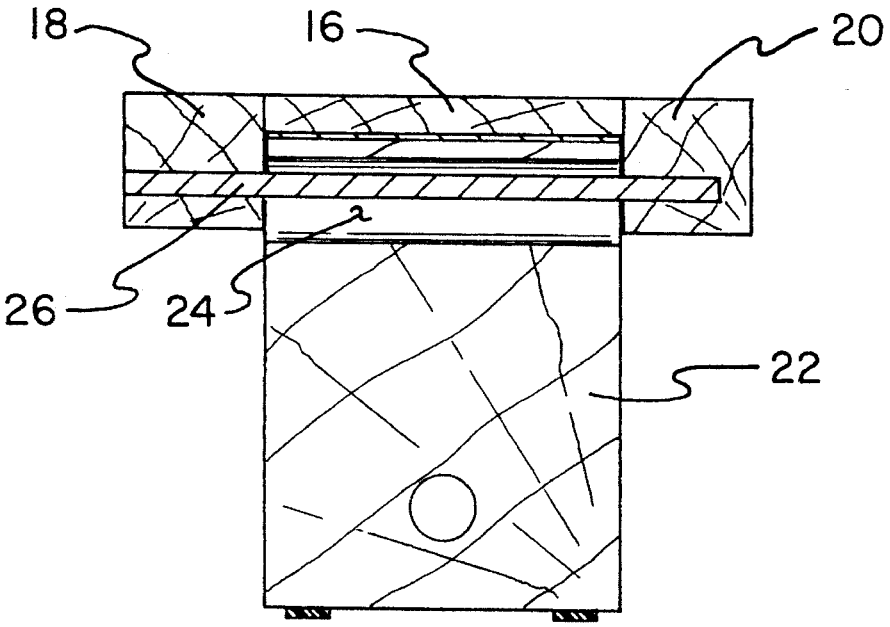
FIG. 5 is a cross-sectional view taken along line 5—5 of FIG. 3.
Figure 6:
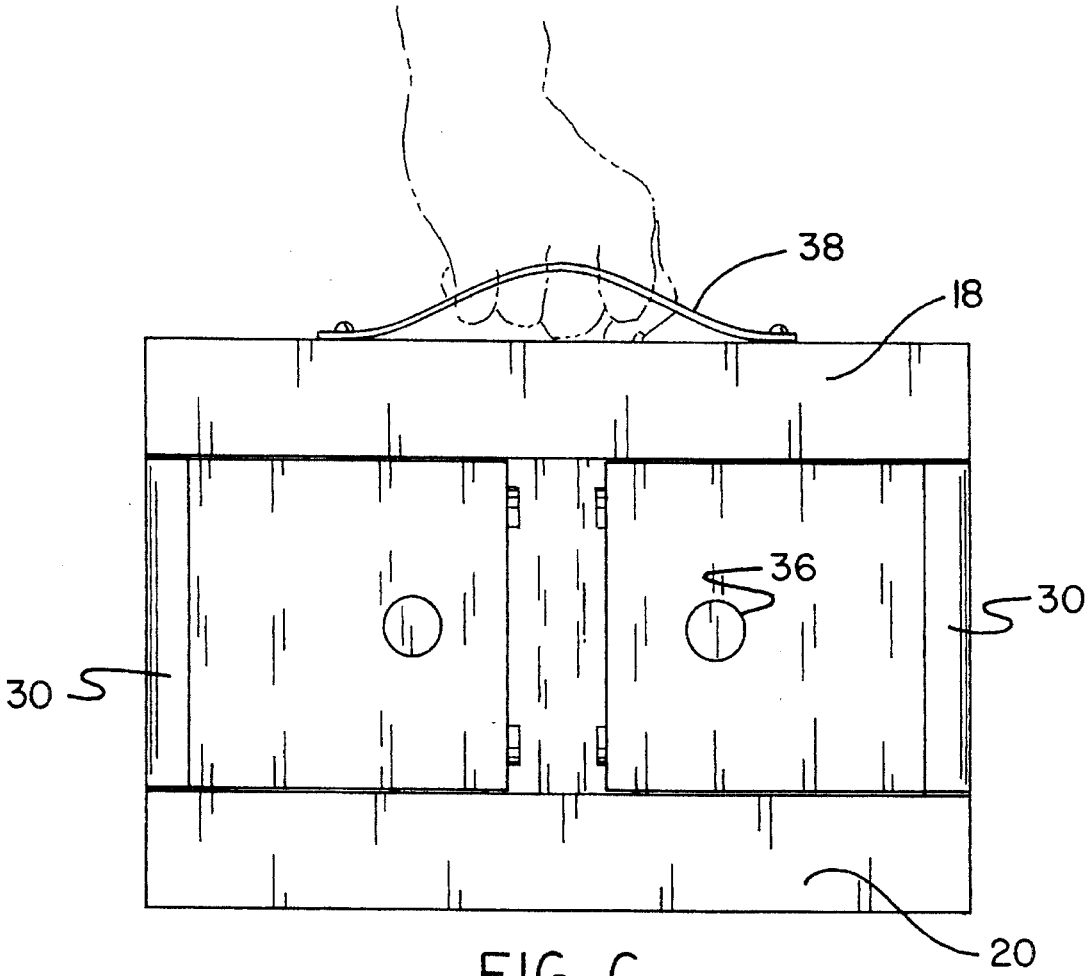
FIG. 6 is a bottom plan view of the invention in a collapsed position.

As shown in FIGS. 3 through 5, the folding leg means 14 of the present invention 10 comprises a pair of substantially rectangular leg members 22 which are pivotally coupled to opposed longitudinal ends of the support means 12. To this end, each of the leg members 22 includes an elongated transverse aperture 24 extending therethrough which permits the passage of the pivot pin 26 through the elongated transverse aperture to pivotally mount the respective leg member 22 beneath the planar member 16 and between the longitudinal members 18, 20 of the support means 12. By this pivotal mounting of the leg members 22 to the support means 12, the leg members may be folded flatly against the support means, as shown in FIG. 6, for storage and/or transportation purposes.

Figure 7:
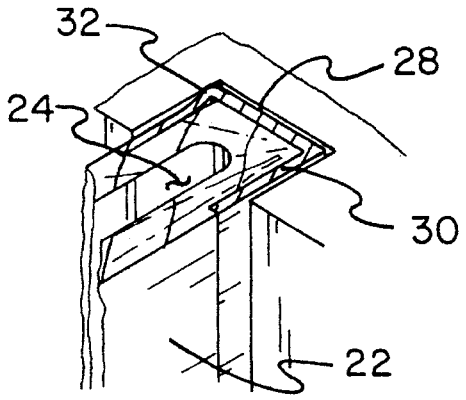
FIG. 7 is an enlarged isometric illustration of a portion of the present invention.

To removably lock the leg members 22 in the extended position shown in FIG. 3, the planar member 16 is shaped so as to define transverse recesses 28 which extend parallel to the pivot pins 26 and are shaped so as to receive an upper end of the leg member 22 therewithin. As shown in FIG. 7, each of the leg members 22 may be provided with a reinforcing end cap 30 extending along the upper end thereof which reinforces the leg member 22 against fracturing or the like due to loads and stresses occurring during use of the device 10. The end caps 30 may each include a projecting longitudinal corner 32 which serves to frictionally engage an interior surface of the transverse recess 28 to preclude an unintentional disengagement of the respective leg member 22 from the transverse recess during lifting or moving of the device. To ensure a level engagement of the leg members 22 to the ground surface positioned therebeneath, each of the leg members is provided with a plurality of resilient feet 34 at a lower end thereof.

Figure 8:
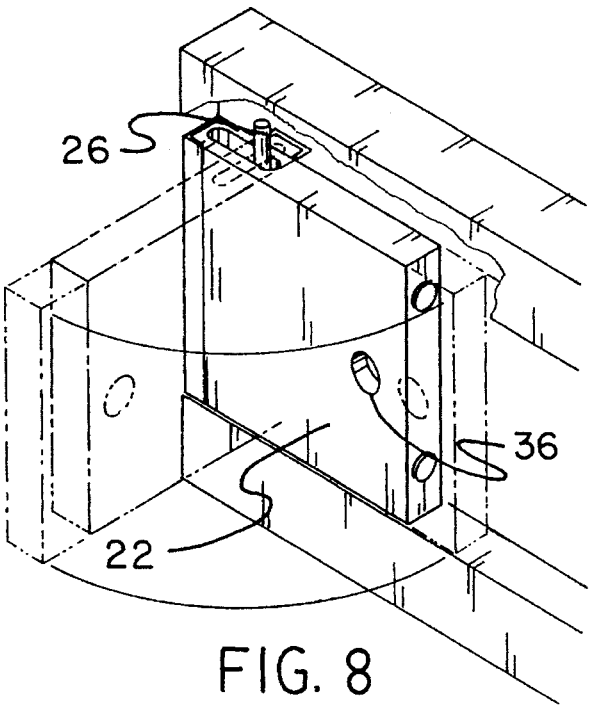
FIG. 8 is a further isometric illustration detailing a movement of a leg member of the invention.

As shown in FIG. 8, each of the leg members 22 can move and pivot relative to the associated pivot pin 26 extending therethrough, however, only in selected directions. To facilitate manual manipulation of the leg members 22, each of the leg members is provided with a finger aperture 36 which receives a tip of an individual's finger to effect sliding and pivotal movement of the leg member. Thus, to effect unfolding or extension of the leg members 22, each of the leg members can be biased towards a center of the support means 12 and subsequently pivoted into a substantially orthogonal relationship relative to the support means. The upper end of the respective leg member 22 can then be positioned into the transverse recess 28, whereby the raised corner 32 will frictionally engage the transverse recess to retain the upper end of the leg member 22 therewithin. The device 10 can then be positioned upon a support surface, as shown in FIG. 1, whereby objects er the individual's legs or feet can then be positioned thereon. To fold the leg members 22 into the closed configuration illustrated in FIG. 6, the above procedure can simply be reversed by removing the upper end of the respective leg member 22 from the transverse recess 28, pivoting the leg member into flat engagement with the lower surface of the planar member 16 and subsequently biasing the leg member 22 outward towards the longitudinal end of the planar member 16, wherein such positioning of the leg member 22 will then preclude unintentional pivoting of the leg member away from the planar member 16. To facilitate carrying of the device 10, a handle 38 can be coupled to a longitudinal member 18 or 20, as shown in FIG. 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable folding footstool comprising:

a planar support means for engaging a portion of an individual, said support means comprising a substantially rectangular planar member; a first longitudinal member coupled to and extending along a first longitudinal side of said planar member; and a second longitudinal member coupled to and extending along a second longitudinal side of said planar member;

a folding leg means coupled to said support means for supporting said support means above a ground surface, said folding leg means comprising a pair of substantially rectangular leg members which are pivotally coupled to opposed longitudinal ends of said support means, each of said leg members including an elongated transverse aperture extending therethrough; and a plurality of pivot pins with each of said pivot pins extending through said elongated transverse aperture of an individual one of said leg members to pivotally mount said leg member beneath said planar member and between said longitudinal members of said support means, wherein said planar member is shaped so as to define a pair of transverse recesses which extend parallel to said pivot pins and are each shaped so as to receive an upper end of an individual one of said leg members therewithin, wherein each of said leg members can move and pivot relative to said pivot pin extending therethrough, whereby each of the leg members is positionable towards a center of said support means and subsequently pivotable into a substantially orthogonal relationship relative to said support means to effect unfolding of said leg members, with said upper ends of said leg members being positionable into said transverse recesses to retain the leg members in said orthogonal relationship relative to said support means; and a pair of reinforcing end caps, with each of said end caps extending along said upper end of an individual one of said leg members, said end caps each including a projecting longitudinal corner which serves to frictionally engage an interior surface of said transverse recess to preclude an unintentional disengagement of said respective leg member therefrom.

2. A portable folding footstool comprising:

a planar support means for engaging a portion of an individual;

a folding leg means coupled to said support means for supporting said support means above a ground surface, said folding leg means comprising a pair of substantially rectangular leg members which are pivotally coupled to opposed longitudinal ends of said support means; and, a pair of reinforcing end caps, with each of said end caps extending along an upper end of an individual one of said leg members, said end caps each including a projecting longitudinal corner which serves to frictionally engage a portion of said support means to preclude an unintentional disengagement of said respective leg member therefrom.

* * * * *